United States Patent [19]

Lundergan

[11] Patent Number: 4,998,896

[45] Date of Patent: Mar. 12, 1991

[54] SEALED STAMPED AND FORMED PIN

[75] Inventor: Robert G. Lundergan, Kernersville, N.C.

[73] Assignee: AMP Incorporated, Harrisburg, Pa.

[21] Appl. No.: 411,961

[22] Filed: Sep. 25, 1989

[51] Int. Cl.[5] ..... H01R 13/40

[52] U.S. Cl. ..... 439/595; 439/274

[58] Field of Search ..... 439/271-283, 439/586, 587, 593, 595, 597, 599, 600, 695, 701, 692-694, 851-858

[56] References Cited

U.S. PATENT DOCUMENTS

| | | | |
|---|---|---|---|
| 3,894,785 | 7/1975 | Hubner et al. | 439/851 |
| 4,252,399 | 2/1981 | Bauerle | 439/851 |
| 4,767,350 | 8/1988 | Cooper et al. | 439/271 |
| 4,826,452 | 2/1989 | Sian et al. | 439/595 |

FOREIGN PATENT DOCUMENTS

| | | | |
|---|---|---|---|
| 3022428 | 12/1981 | Fed. Rep. of Germany | 439/851 |

*Primary Examiner*—David L. Pirlot

*Attorney, Agent, or Firm*—Robert W. Pitts; Allan B. Osborne

[57] ABSTRACT

A sealed electrical connector assembly (2) used to interconnect wires (4) with a printed circuit board comprises a receptacle connector (6) matable with a pin header (8). The receptacle connector (6) includes a secondary lock (60) located on the mating face of an insulative housing (30). Integral latches 50 are received within correspondingly shaped pocket (62) in the secondary lock. A conductor seal cap includes a plurality of projections which can be selectively removed. Remaining projections seal individual seal cavities. A stamped and formed pin is used in the pin header. An integral plug is used to seal the leak path on the interior of the stamped and formed cylindrical pins.

16 Claims, 12 Drawing Sheets

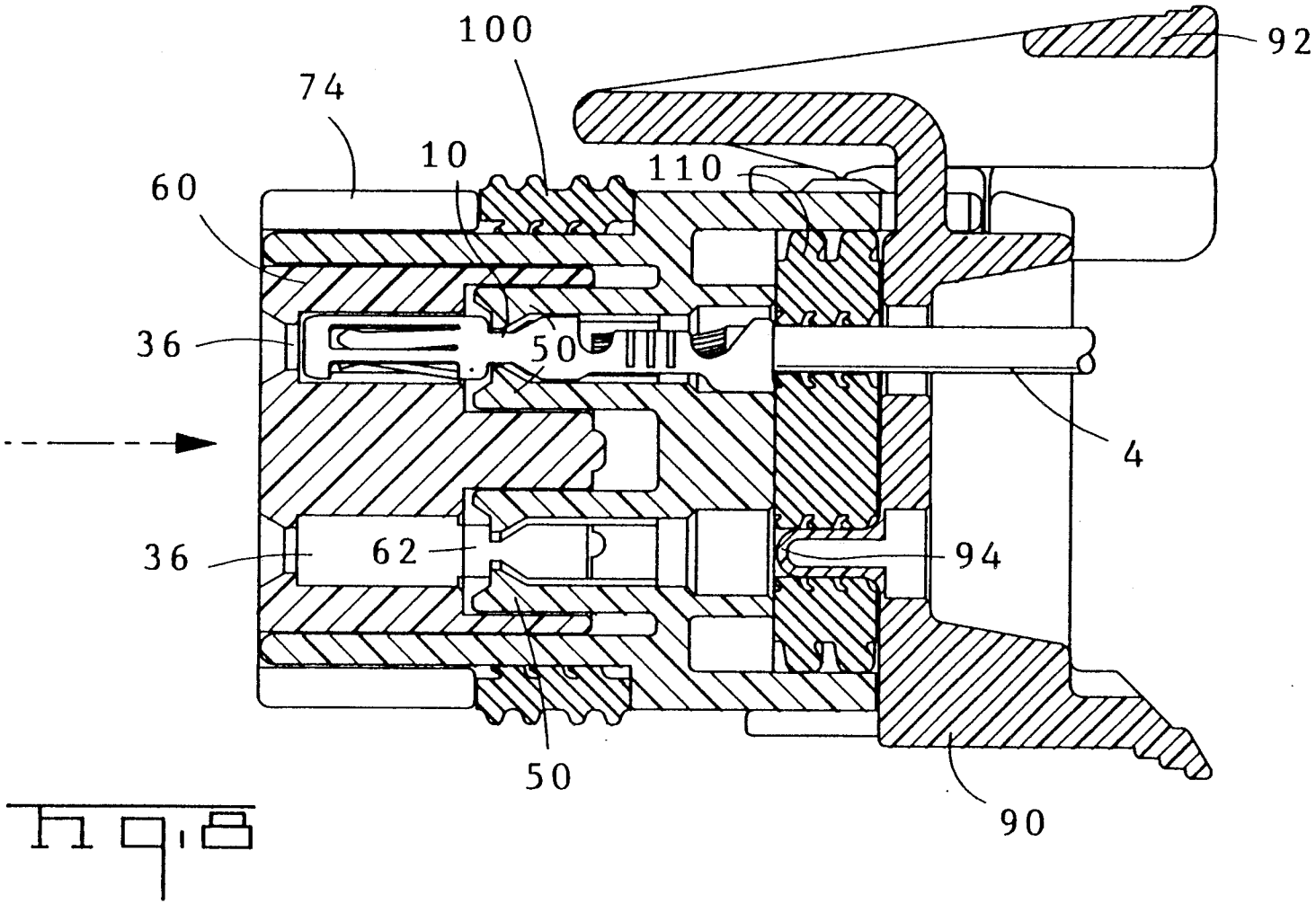
92
4
90
94
110
100
50
50
10
62
74
60
36
36

28
24a
24b
26a
27
136a
136b
120
126
138
124a
124b
128
130
20
22
13
26b
29

4
19
18
16
17
15
12
10
14
28
20
24a
24b
26a
27
26b
29
120
138
24b

SEALED STAMPED AND FORMED PIN

BACKGROUND OF THE INVENTION

1. Field of the Invention

This invention relates to a stamped and formed cylindrical pin for use in an electrical connector and more specifically relates to a stamped and formed pin including a sealed plug on the interior of the pin.

2. Description of the Prior Art

U.S. Pat. No. 4,760,350 discloses a sealed receptacle and plug connector assembly for use in terminating a plurality of conductors to a printed circuit board. Stamped and formed pins located in a pin header include rear section which is bent at right angles and is secured to the rear of the header. The front of the stamped and formed pins are stamped into a cylindrical configuration. These cylindrical or tubular pins have a seam line where portions of the flat metal blank forming the tubular pin abut. The seal which can be established along the seam line exhibit limited performance capabilities. The instant invention provides a means for sealing a stamped and formed pin in an electrical connector which provide enhanced performance over that previously exhibited by the prior art.

SUMMARY OF THE INVENTION

A stamped and formed pin suitable for use as an electrical connector is fabricated as a cylindrical member from a flat blank. A plug is positioned on the interior of the stamped and formed pins to seal the leak path extending through the pin. This plug comprises a portion of the flat metal blank which is partially sheared from the center of the blank, the plug remaining joined to the blank by an integral tail. The contour of the plug has substantially the same shape as the inner surface of the tubular pin. The pin is fabricated by bending the tail upwardly and then forming portions of the flat metal blank around the plug to form a metal to metal seal.

BRIEF DESCRIPTION OF THE DRAWINGS

FIG. 3 is an exploded view showing the plastic parts and elastomeric sealing elements of the receptacle connector.

FIG. 8 shows final assembly of the connector with the secondary lock feeding the resilient latches in pockets formed in the secondary lock.

FIG. 13A is a section view taken through the plug along section lines 13—13 as shown in FIG. 12.

FIG. 13B is a section view showing a first intermediate step in the fabrication of the plugged stamped and formed cylindrical pin.

FIG. 13C is a section view showing a second intermediate step in the fabrication of the plugged stamped and formed cylindrical pin.

FIG. 15 is a exploded perspective view of the receptacle terminal and the stamped and formed cylindrical pin.

DETAILED DESCRIPTION OF THE PREFERRED EMBODIMENT

Figure 1:
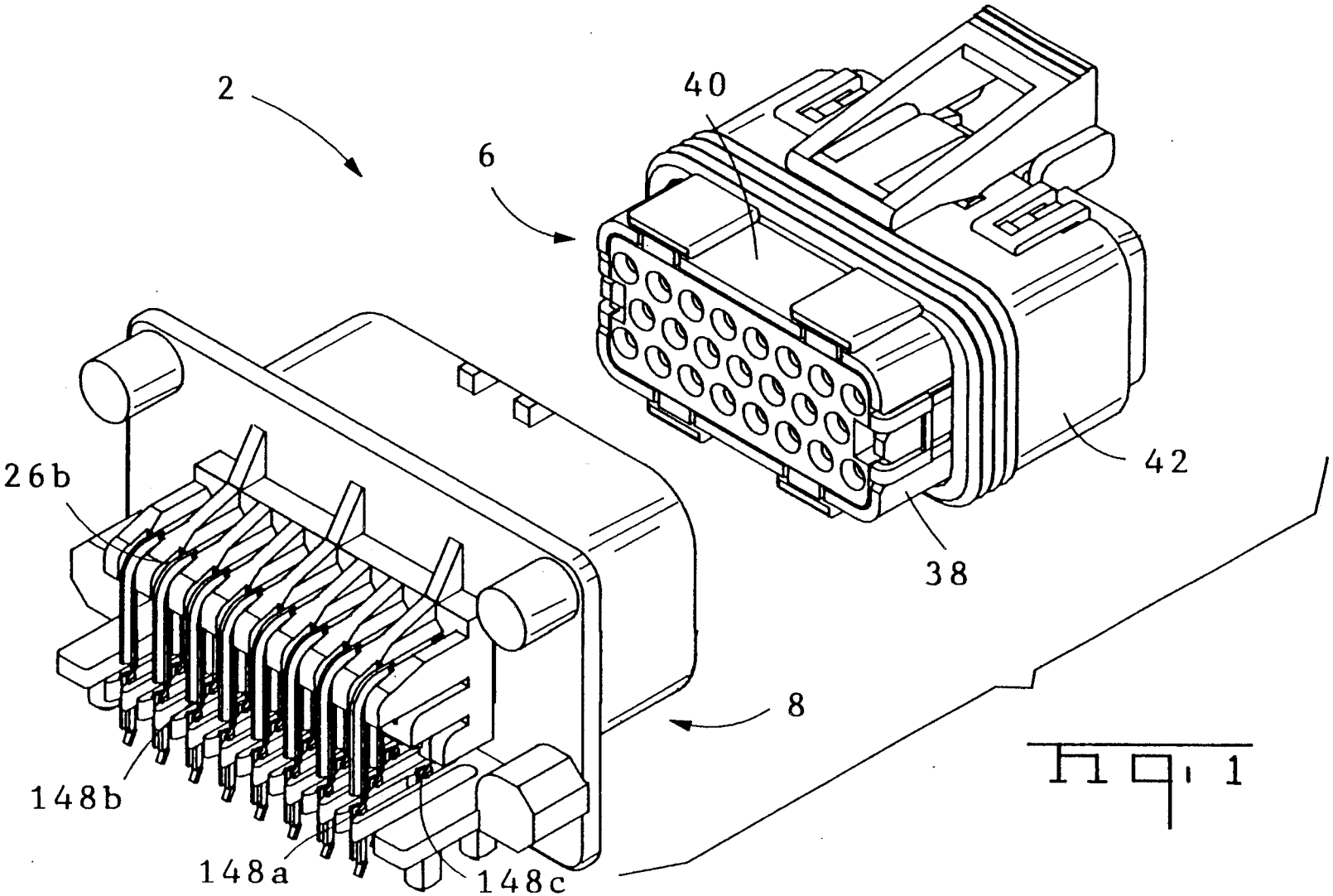
FIG. 1 is a perspective view showing a circuit board header and a receptacle connector exploded from the pin header with which the receptacle connector would mate.

The sealed electrical connector assembly comprising the preferred embodiment of this invention is intended for use in establishing sealed interconnection to conductors in a densely populated array. The sealed connector assembly 2 comprising the preferred embodiment of this invention be used with conductors at any arbitrary location, less than the total number of terminal position in the housing. Sealing integrity is established with each of the electrical conductors, such as wires, and sealing integrity can be established with individual wires and along individual circuits even though all of the positions in the connector are not filled with terminals. Electrical connector or receptacle connector 6 is employed to mate with a mating connector or shrouded pin header 8 Electrical terminals 10 are mounted in the electrical connector 6 in a plurality of rows. In the preferred embodiment of this invention terminals 10 are mounted in three rows, the center row being staggered with respect to the terminal positions in the outer two rows. Terminals 10 are attached to wires 4 and are matable with stamped and cylindrically formed or tubular pins 20. Terminals 10 are positioned within an insulative housing 30 and the pins 20 are positioned within a header housing 140 of the pin header 8.

Figures 5, 14:
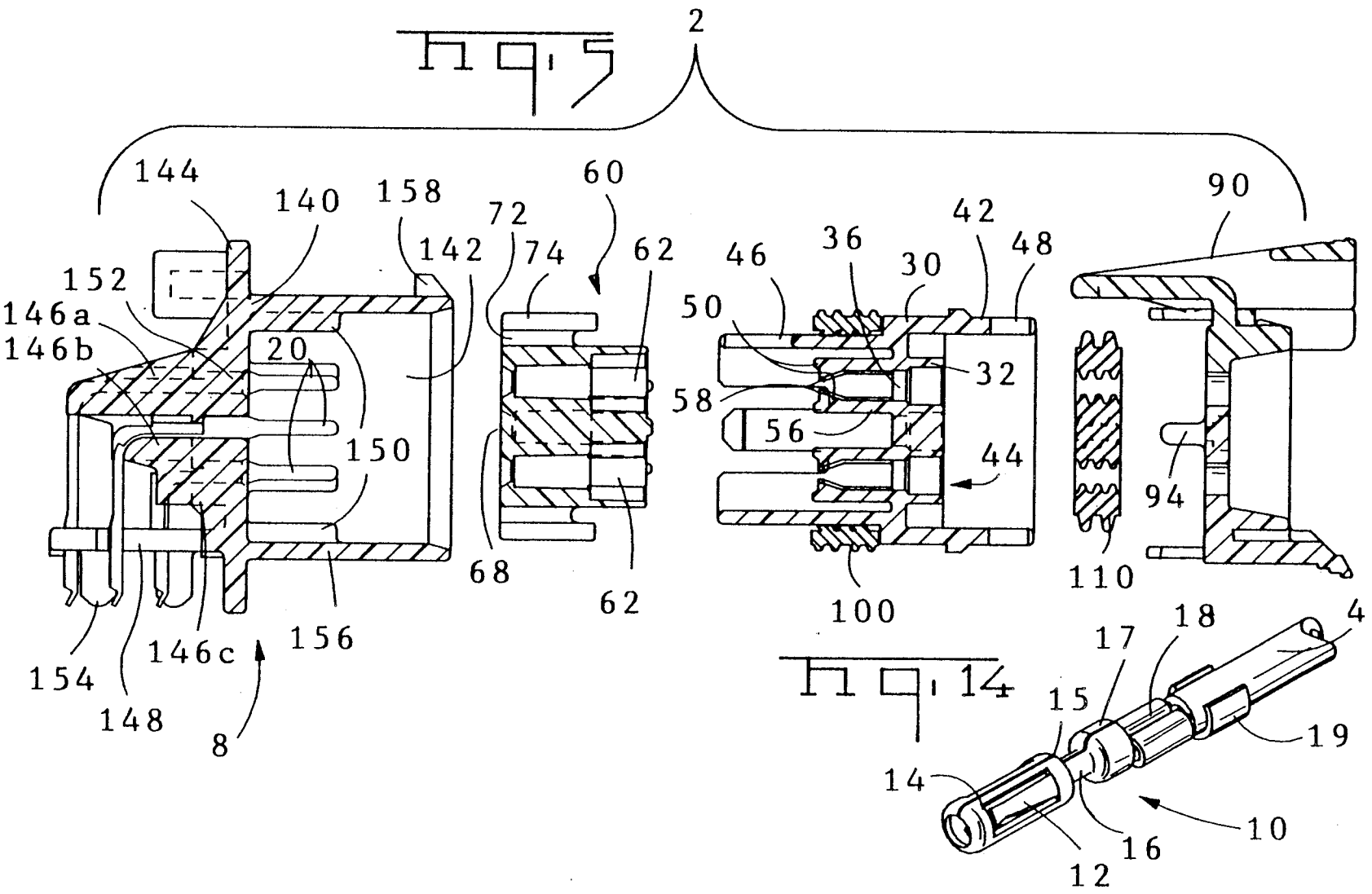
FIG. 5 is an exploded sectional view showing the parts of the connector shown in FIGS. 3 and 4.
FIG. 14 is a perspective view of the receptacle terminal employed in the receptacle connector.

Each of the terminals 10, as shown in FIG. 14, include a plurality of contact springs 12 which are in the form of cantilever beams positioned within a tubular or barrel contact section 14. In the preferred embodiment of this invention these contact springs 12 extend forwardly from the rear of the barrel shaped sections toward the front. A shoulder 15 is formed at the rear of the barrel contact section 14 and a waist section 16, having a reduced outer diameter, is formed between the barrel contact section 14 and a stabilizing section 17 having an outer diameter substantially equal to the outer diameter of the barrel contact section 14. Barrel shoulder 15 forms a well defined shoulder between the barrel contact section 14 and the waist section 16. A conventional wire crimp section 18 is located adjacent the cylindrical stabilizing section 17 and an insulation crimp 19 of conventional wrap around construction is located at the rear of terminal 10. The terminal is crimped in such a manner that the elastomeric seals will not be damaged when a crimped terminal is inserted through the seal. Each terminal 10 can be crimped to a stripped end of a wire 4 in a conventional manner.

Terminals 10 are positioned within a insulative housing 30 having an insulative base 32 through which a plurality of openings or cavities extend in rows corresponding to the rows in the array of terminal positions. These openings or cavities 36 form means for positioning terminals in three staggered rows extending between opposite end walls 38 of the insulative housing 30 and parallel to opposite sidewalls 40. Housing 30 has a mating face 34 in the shape of a rectangular mating envelope formed by opposite end walls and opposite sidewalls. The end walls 38 and sidewalls 40 forming this mating envelope extend forward from the insulative housing base 32. Insulative housing 30 is open within the envelope formed by end walls 38 and sidewalls 40 from the insulative housing base forward. A plurality of grooves 46 are provided in each sidewall 40. In the preferred embodiment of this invention the grooves 46 in the upper sidewall are spaced apart by different distance than the grooves 46 in the lower sidewall. The grooves 46 thus polarize the mating envelope formed at the mating face 34 of the insulative housing 30.

An insulative housing shroud 42 is located at the rear end of the insulative housing and extends rearwardly from the insulative housing base 32. Housing shroud 42 protrudes beyond the sidewalls 40 and beyond the end walls 38 such that the mating envelope has smaller outer dimensions than the housing shroud 42. A shoulder is formed at the juncture between the end walls 38 and the sidewalls 40 forming the mating envelope and the housing shroud 42. A plurality of grooves 48 adjacent the rear end 44 of the housing are also formed in the shroud 42. Again, grooves in opposite walls of the housing shroud are located in a different configuration on the top and bottom walls of the shroud 42 to polarize the housing shroud.

Figure 18:
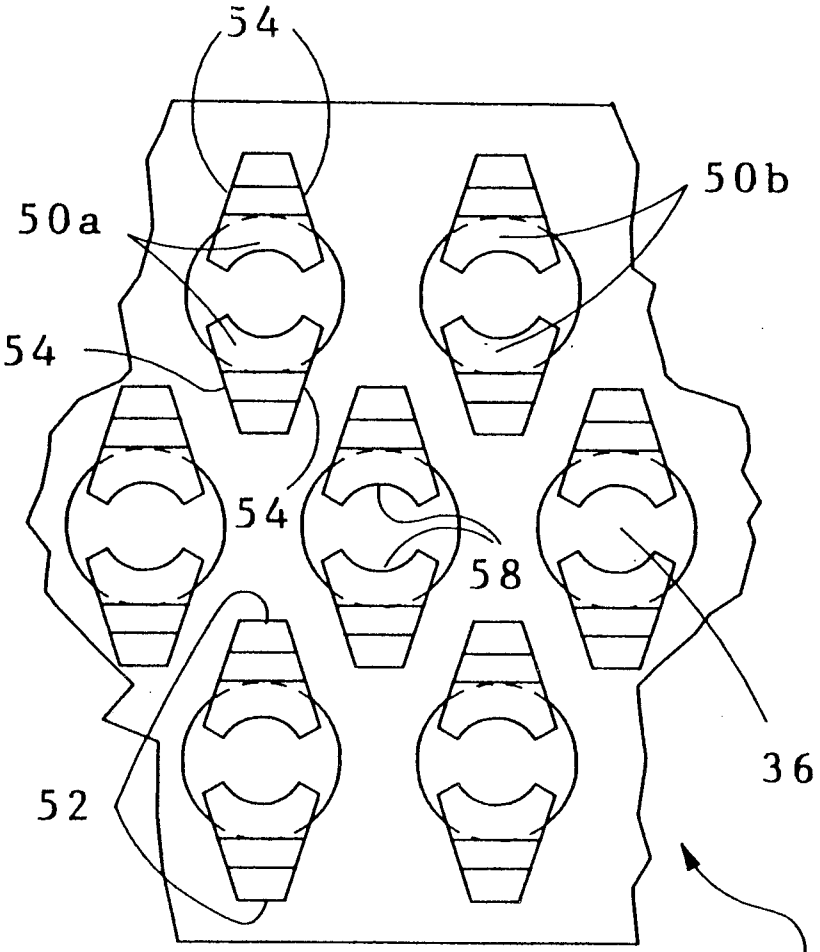
FIG. 18 is a front view showing the shape of the latches used on the insulative housing.

A plurality of resilient plastic latches 50, integral with the insulative housing 30 extend from the insulative housing base 32 towards the mating face 34. Each of these latches 50 comprises means for securing terminals in the insulative housing. Latches 50 are located on the interior of end walls 38 and sidewalls 40 within a large mating cavity on the insulative housing. Each of the latches comprises a resiliently deflectable beam extending from base 32. As best seen in FIG. 18, each of the latches 50 has a generally triangular cross section with exterior surfaces 54 of each latch converging towards an apex 52 with distance away from the respective terminal 10 secured by the latch. In other words, the exterior surfaces 54 of each latch 50 converge towards an apex 52 with distance away from the center line of the opening 36 in the insulative base 32. Two latches, positioned in surrounding relationship to each terminal 10 protrude from the insulative housing base 32 on the periphery of each opening 36 to secure each terminal extending through and positioned by each corresponding opening 36. Since the exterior surfaces 54 of each opposed pair of latches 50 converge towards opposite apices 52, each opposed pair of latches generally forms a diamond shape configuration. Engaging surfaces 58 in the form of curved lips protrude inwardly from the triangular shaped cantilever beams 56 forming the latches 50. These engaging lips 58 protrude into the cylindrical contour of the openings 36 and provide a means for gripping a terminal 10 inserted through an opening 36.

The latches 50 in each row are staggered with respect to latches 50 in an adjacent row. The tapered latches 50 can be positioned in partially overlapping relationship. In this manner the rows of terminal positions in the terminal array can be more closely spaced. In other words, openings 36 can be more closely spaced. In this manner a denser population of terminal positions can be achieved. As shown in in FIG. 18 the apices of latches in each outer row overlap the apices 52 of latches 50 in the adjacent center row.

Figure 19:
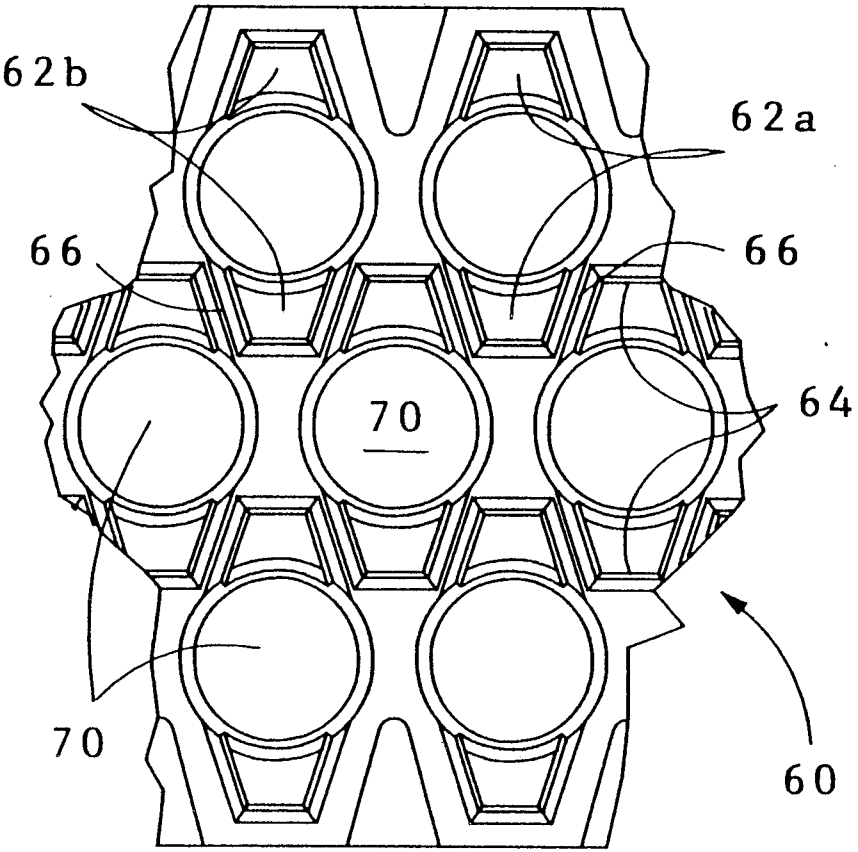
FIG. 19 is a front view showing the shape of the individual pockets employed in the secondary lock member.

Secondary housing member 60, mountable in telescoping relationship to the front of the insulative housing 30, comprises a secondary lock. Secondary lock 60 is shiftable from a first position shown in FIGS. 6 and 7 to a second position shown in FIG. 8. Secondary lock 60 has a plurality of pockets 62 arranged in a plurality of rows in the secondary lock 60. As shown in FIG. 19, individual pockets are substantially diamond shaped with the apices 64 of pockets in adjacent rows overlapping. In the preferred embodiment of this invention the pockets are located in three rows with the pockets in the center row be staggered with respect to pockets in the outer two rows. As with latches 50, pockets 62 only partially overlap pockets in adjacent rows. The pockets 62 are formed by diagonal wall sections 66 which are interwoven to define a honeycomb structure. Diagonal wall section 66 extend rearwardly from an outer secondary housing member base or outer partition 68. Apertures 70 in the form of generally circular holes, having a tapered end adjacent the outer face of the secondary lock 60, have a generally circular or cylindrical shape and each aperture 70 is aligned with a corresponding diamond shaped pocket 62. The diagonal wall section 66 located beyond each aperture 70 such that the diamond shaped pocket 62 align with aperture 70 are generally larger than the aperture 70. The diagonal wall sections are located only on the interior of the secondary lock 60 and extend from the rear of the aperture 70 to the rear end of the secondary lock 60. Note that the apertures 70 have generally circular cross-section which merges with the diamond shaped cross-section of the pocket defined by the diagonal wall sections 66. As with the pockets 62 the aperture 70 are staggered in adjacent rows. Each aperture 70 is offset from diagonal wall section 66 in a secondary lock 60 so that mating terminals in the form of pins 20 can be inserted through apertures 70 and the pins will be spaced from the diagonal wall sections 66.

As best shown in FIGS. 18 and 19, the shape of the latch pairs 50 and the corresponding pockets 62 are substantially the same so that the latches 50 can be inserted into corresponding pockets 62. Latches 50 are however received in respective pockets 62 only when the secondary lock 60 is in the second position shown in FIG. 8 and when the latches 50 are in a position securely engaging corresponding terminals 10.

Secondary lock 60 includes a plurality of tongues 72 extending outwardly from opposite sidewalls 40. The tongues merge with a laterally extending platform 74 so that each tongue and platform essentially has a T shaped configuration. Tongues 72 are positioned to correspond with the location of grooves 46 on the top and bottom sidewalls 40 of housing 30. Tongues 72 interfit with the grooves 46 so that the pattern of tongues and grooves provide a keyed orientation between the insulative housing and the secondary lock 60. The integral tongue 72 and platform 74 also provide a means for orienting or keying the connector 6 with respect to a mating connector 8 since these T-shaped tongues and platform configurations are located adjacent to mating face of connector 6.

Figures 7, 20, 21:
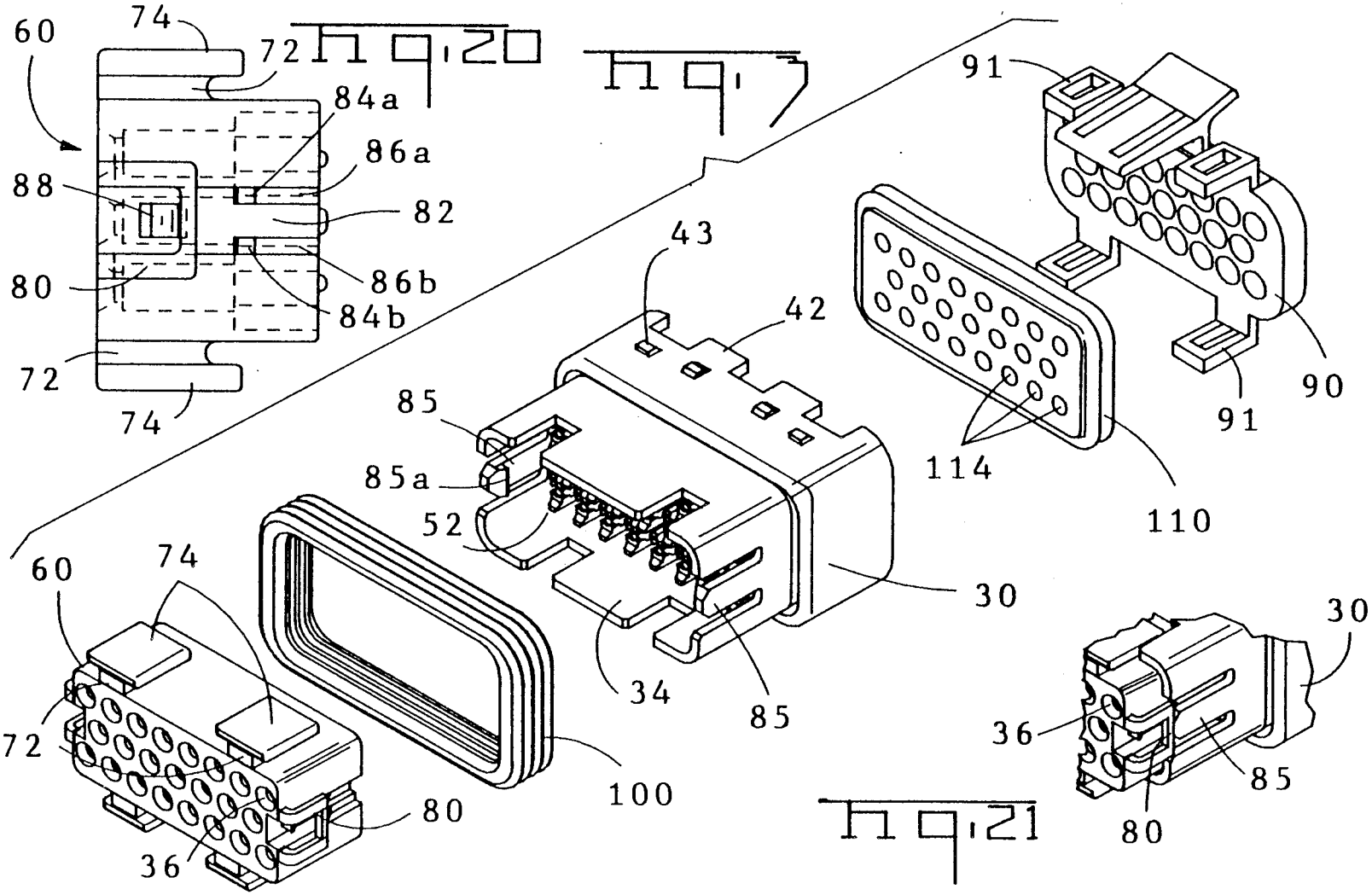
FIG. 7 is a view similar to FIG. 6 showing complete insertion of a terminal into the insulative housing.
FIG. 20 is a side view of the secondary lock showing two position retainer elements on the secondary lock.
FIG. 21 shows the secondary lock member in the shipped configuration with the latching finger engaging the strap to prevent the secondary lock from inadvertently shifting to the closed position.
Figure 4:
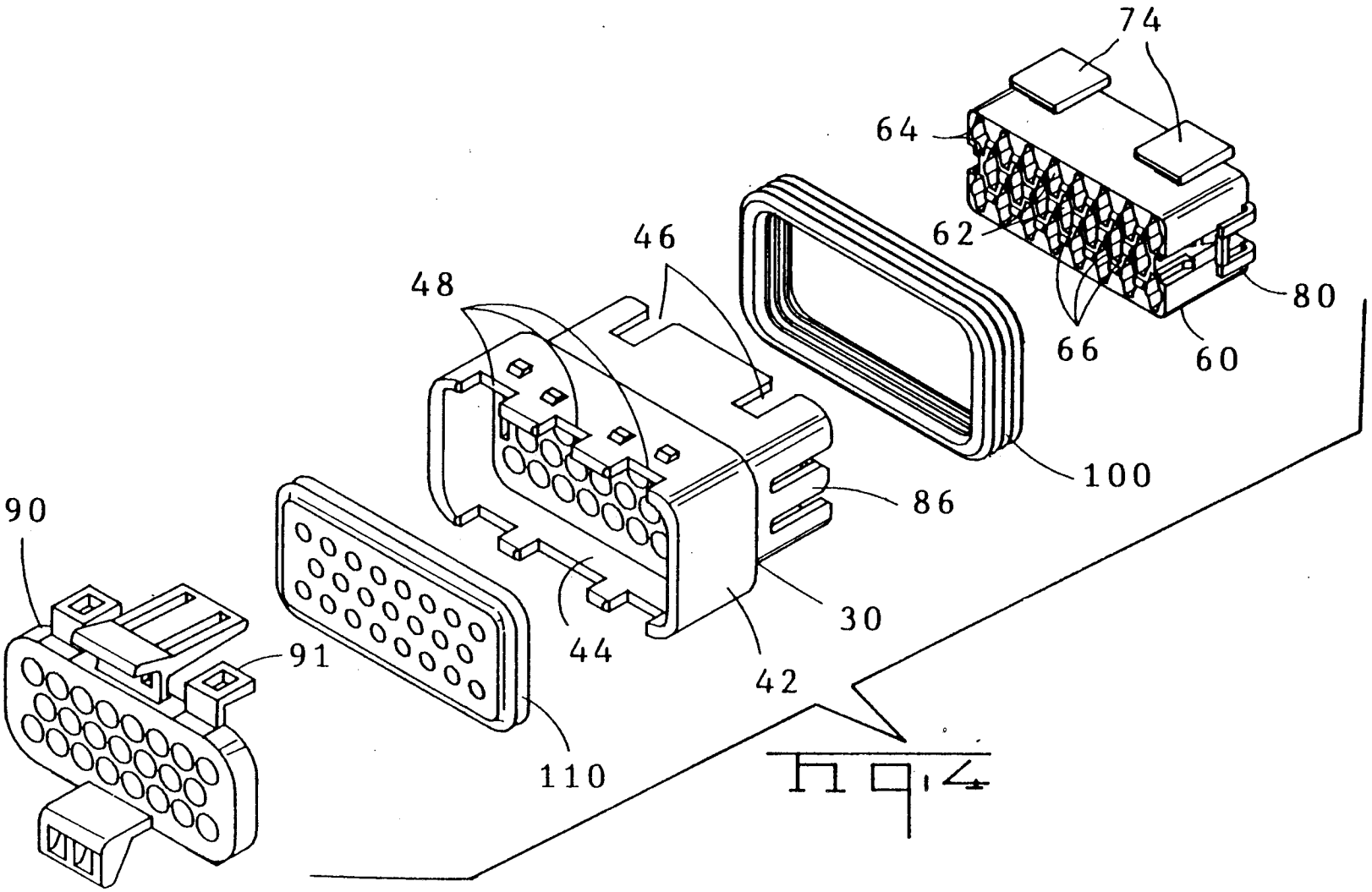
FIG. 4 is an exploded view showing the same parts as shown in FIG. 3 but showing the opposite faces of each component part.
Figure 6:
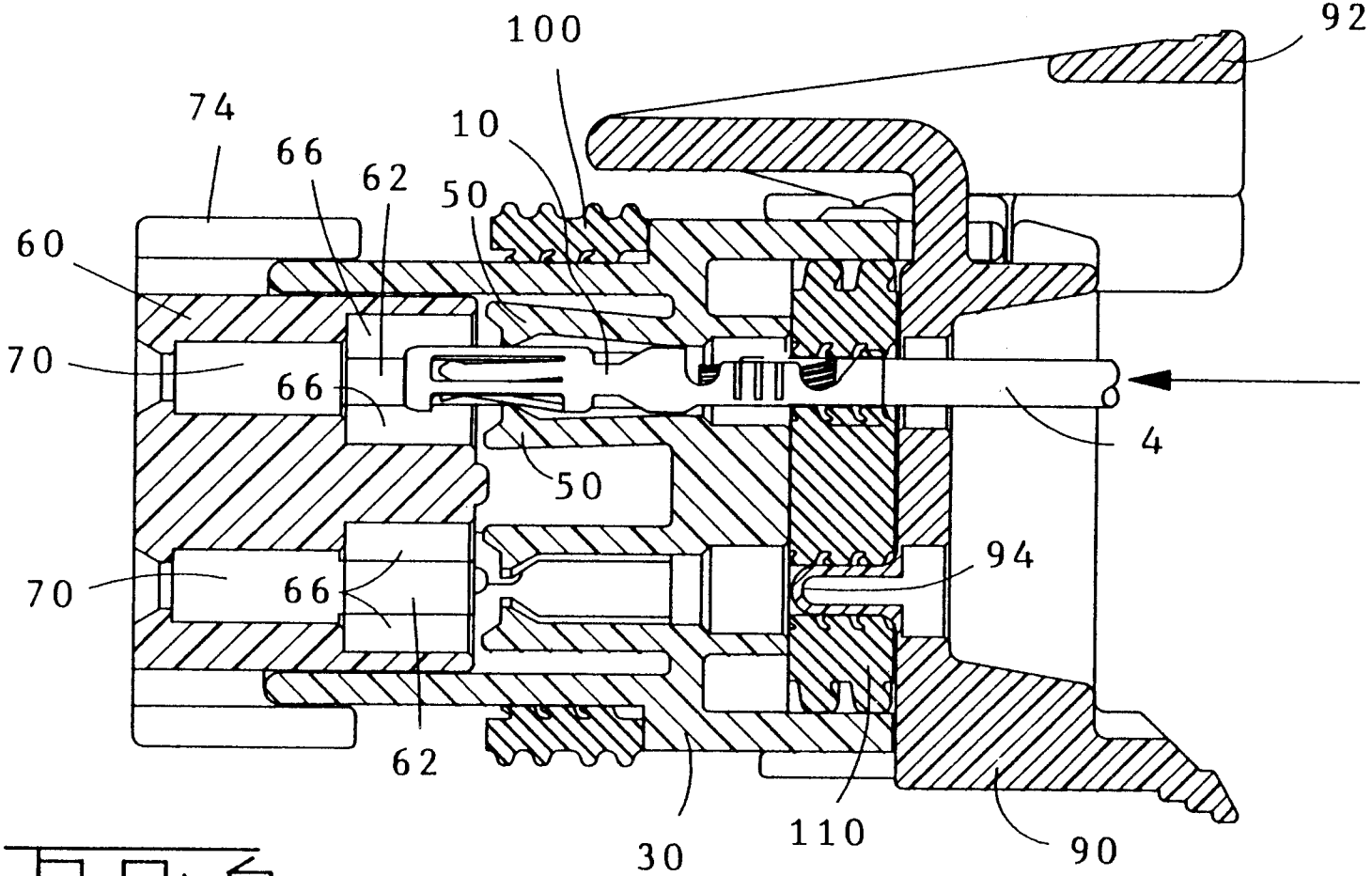
FIG. 6 is a sectional view of the receptacle connector showing initial insertion of a terminal into the connector housing.
Figure 7:
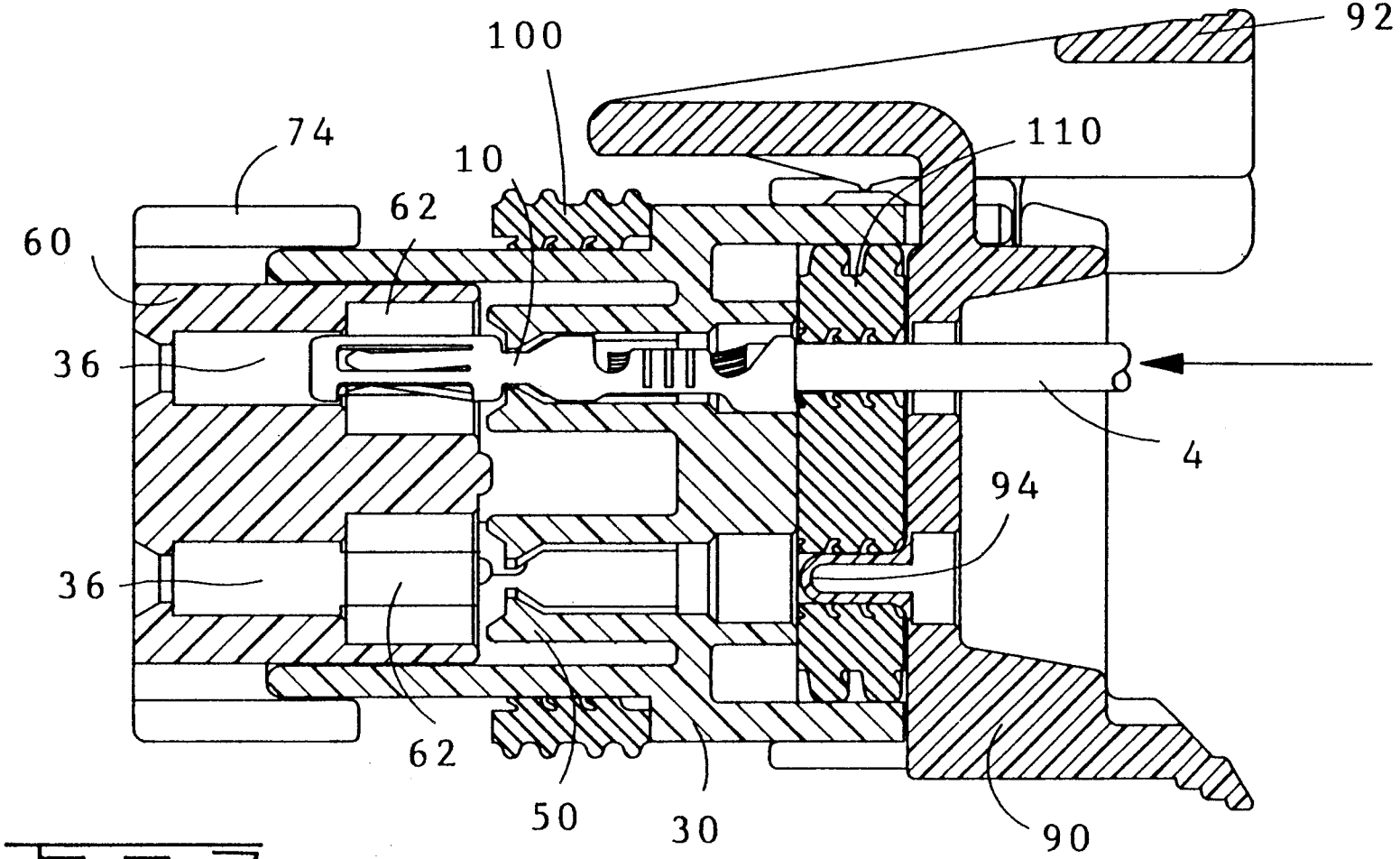

Secondary lock 60 can be attached to the insulative housing 30 in the first position of FIGS. 6 and 7 as well as in the second position shown in FIG. 8 by a two position retainer means comprising a finger 85 on the sidewalls 38 of the insulative housing 30 which is engagable with spaced apart mating shoulders 84 and 86 on the ends of the secondary lock 60. Referring to FIGS. 3, 20 and 21, the two position retainer means also includes an outer strap 80 which overlaps fingers 85 when the secondary lock 60 is in the closed second position. Mating shoulders 84 and 88 are located within a channel 82 on one end of the secondary lock 60. Two internal shoulders 84 are located on two spaced apart ridges **86*a* and 86*b* located adjacent to the edges of channel 82. Shoulders 84 include an inclined ramp surface facing the rear of the secondary lock 60 and a perpendicular locking shoulder section facing the outer or mating face of the secondary lock. The external shoulder 88 is located between the internal shoulders 84 and the mating face of the secondary lock 60. Outer shoulder 88 is centrally positioned with channel 82 laterally between the two spaced apart ridges 86*a* and 86*b* as shown in FIG. 20. When the secondary lock is in the first position as shown in FIGS. 6 and 7, an inwardly facing latching shoulder 85A on finger 85 engages the internal shoulders 84 on the secondary lock. In this position, locking shoulder 85*a* is positioned between the internal shoulder 84 and the external shoulder 88. In this position each finger 85 abuts the outer strap 80. Since each finger 85 cannot be shifted past the corresponding strap 80 into the closed position without first depressing each finger 85, the secondary lock 60 cannot be inadvertently shifted from the position of the secondary lock shown in FIG. 6 in which the subassembly is shipped. When the secondary lock 60 is shifted to the second position in FIG. 8, the lock and shoulder 85*a* is cammed outwardly over an inclined ramp surface on the external shoulder 88. When the secondary lock 60 is in the second position, the latching finger 85*a* is free to return to its normal position and the shoulder 85*a* will engage the locking surface on the outer face of external shoulder 88 to firmly secure the secondary lock 60 to the insulative housing 30**.

A cap 90 is received within the shroud 42 at the rear of insulative housing 30. Cap 90 comprises both a seal cap used in conjunction with conductor seal 110 and a latching mechanism for securing connector 6 to a mating connector such as pin header 8. Cap 90 has a plurality of s snaps 91 engagable with protrusions 43 on the exterior of shroud 42 to secure the cap 90 to the insulative housing 30 and to secure the conductor seal 110 within the insulative housing shroud 42. Cap 90 also has a connector latch 92 extending forwardly from its upper edge and protruding beyond the shroud 42 for securing the electrical connector 6 to mating header 8. By positioning this connector latch 92 on the cap 90, the insulative housing 30 can be more easily manipulated by automated equipment since the latch would not be in the way.

The elastomeric seal 110 used to establish sealing integrity around individual conductors or wires 4 comprises a single piece family seal formed of a conventional elastomeric material. Seal 110 has a plurality of holes 114, each hole being dimensioned to receive a wire and to establish sealing integrity with that wire. Seal 110 also has peripheral sealing ribs 112 for establishing sealing integrity with the interior surface of the shroud 42. Seal 110 comprises a conventional family seal for establishing sealing integrity with a plurality of individual conductors. Seal 110 is positioned within shroud 42, and each individual hole 114 will be aligned with an opening or cavity 36 in the insulative housing 30 and with a pocket 62 in the secondary lock 60.

Figures 17A, 17B, 17C, 17D:
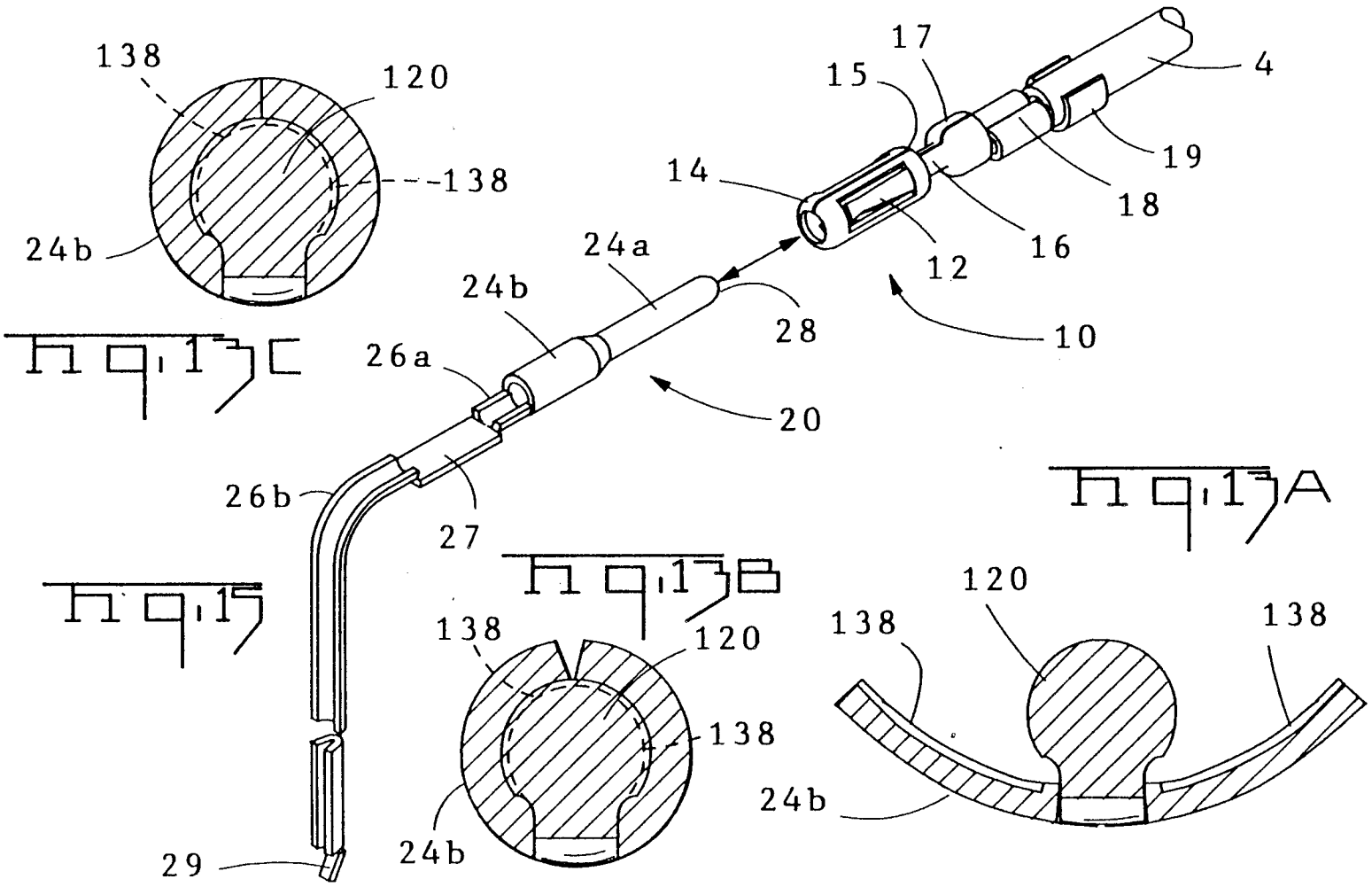
FIG. 17 is a perspective view showing a one piece family seal employed with electrical conductors and the seal cap, showing the manner in which the seal cap is programmed.
Figures 16, 17:
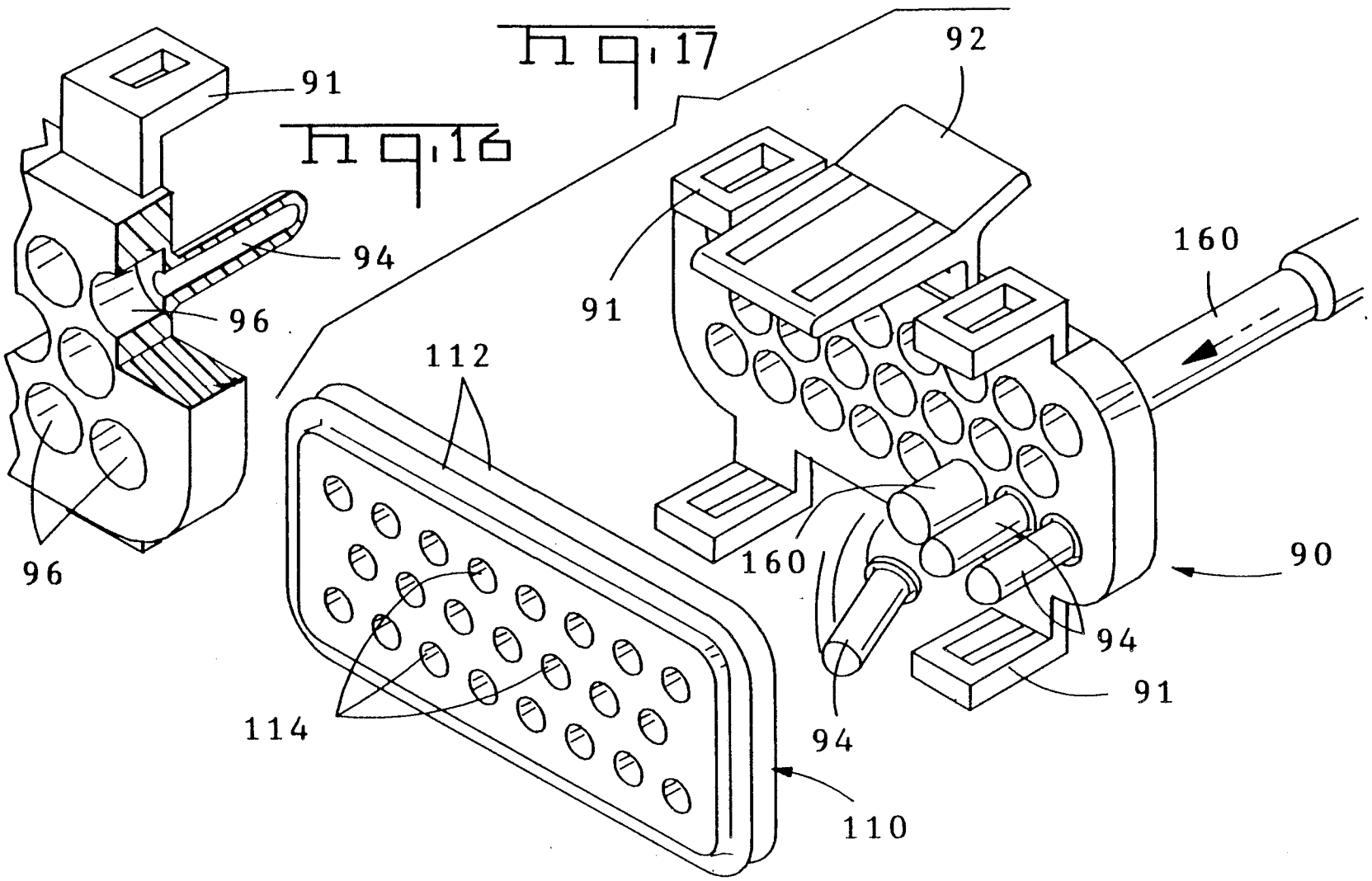
FIG. 16 is a fragmentary perspective view, partially in section, of the seal cap.

Although most conventional family seals such as seal 110 are intended for establishing sealing integrity with wires 4 inserted in all of the holes 114, means are provided on seal cap 90 for closing off any holes 114 in which no wire 4 is positioned. Seal cap 90 comprises a programmable plate. Programmable plate has a plurality of selectively removable projections 94 extending from one surface. These projections 94 are dimensioned for seating within a corresponding hole 114 on elastomeric seal 110. Cap 90 can be manufactured of a conventional plastic material with projections 94 located in a pattern corresponding to the array of terminal positions or corresponding to the array of holes 114 in the seal 110. Only selected or arbitrary terminal positions might be needed in certain applications of this sealed electrical connector assembly 2. Projections 94 can be removed from the seal cap programming plate only if those positions where a terminal is to be located. The remaining projections 94 can then extend through corresponding holes 114 in the elastomeric sealing member 110 thus providing closing holes 114 where no terminated wire is located. As shown in FIG. 16, seal cap 90 has a plurality of indentations 96 aligned with projections 94 on the opposite side of the plate. Selective projections can be removed by punching out the material in the corresponding indentation 96 using a suitable punching tool 160 in the manner shown in FIG. 17. Thus, sealed connector assembly 2 can be programmed for a specific application merely by punching out projections 94 on the plate 90.

Figure 2:
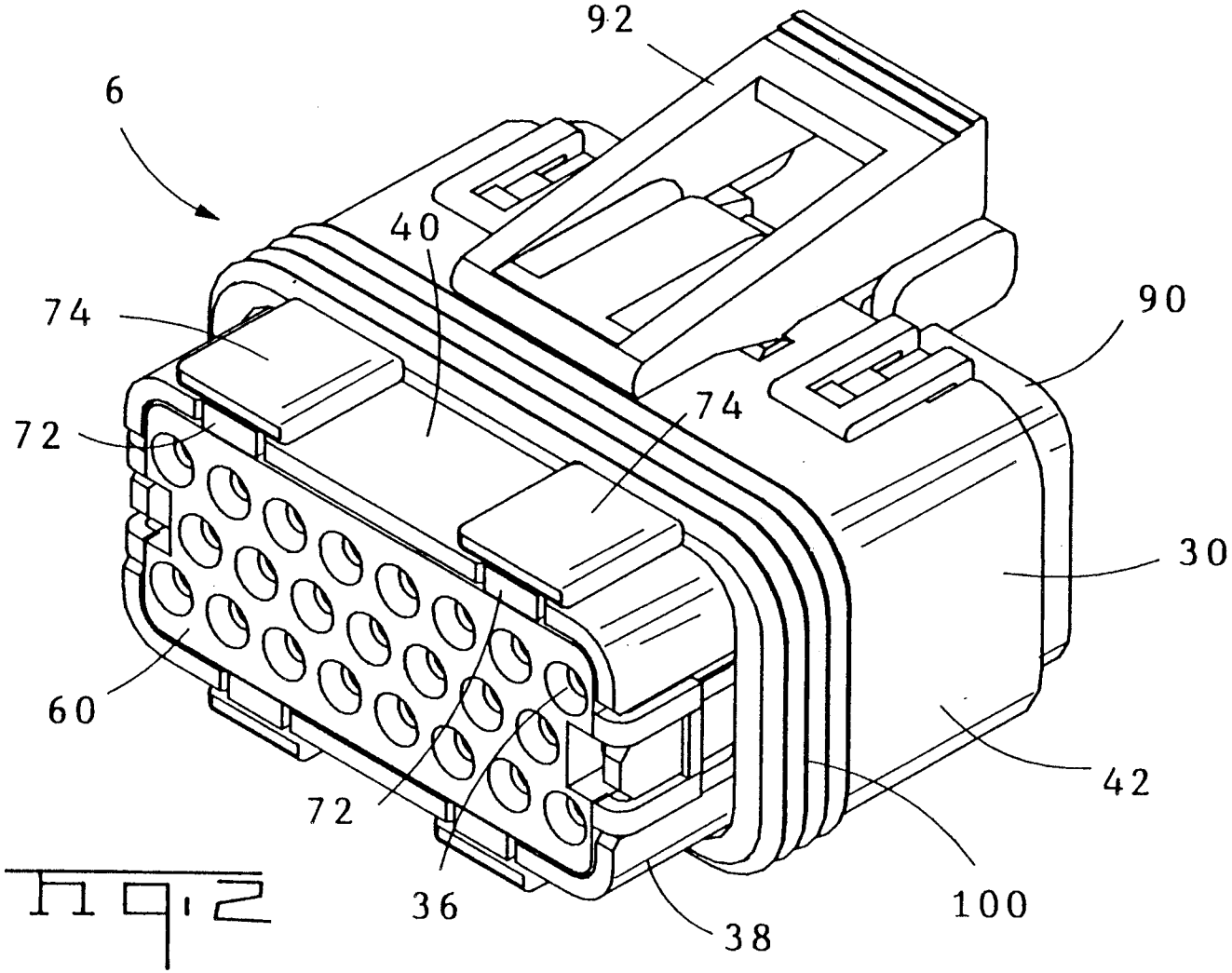
FIG. 2 is a perspective view of the receptacle connector in is fully assembled configuration.

In addition to the conductor seal 110, connector 6 includes a peripheral interfacial seal 100 located at the mating interface between connector 6 and pin header 8. As shown in FIG. 2, seal 100 is located between the secondary lock 60 and the shroud 42 on the insulative housing 30.

Although connector 6 could be used to establish an interconnection between two multi-conductor cables, connector 6 is preferably employed with a mating pin header 8. Pin header 8 includes a plurality of stamped and formed tubular or cylindrical pins 20. Each stamped and formed pin 20 has first and second tubular sections **24*a* and 24*b*. Each pin also has a third channel section 26 which in the preferred embodiment of this invention includes a right angle bend and a portion of channel 26*b***.

Channel section 26 includes two spaced apart sections 26*a* and 26*b*. Section 26*a* is located adjacent the second or larger tubular section 24*b*. A flattened section 27 is located between the two channel shaped sections 26*a* and 26*a*. The first tubular section 24*a* has a tapered nose 28 formed in a conventional manner. The stamped and formed pin 20 is formed from a flat metal blank 130. Blank 130 has a first section 136*a* and a wider second section 136*b* from which the first and second tubular sections 24*a* and 24*b* respectively are formed. Since second section 136*b* is wider, the corresponding second tubular section 24*b* will have a larger outer diameter than the first tubular section 24*a*. To seal the leak path through the interior of the tubular pins 20, a plug 120 is located within the wider second tubular section 24*b*. Plug 120 establishes a metal to metal seal with the inner surface 22 of the tubular pin 20. Plug 120 is formed from a portion of the second tubular section 136*b* of the metal blank 130. Plug 120 is formed by partially shearing the plug from the center of the blank. Plug 120 remains joined to the blank 130 by an integral tail 128. The contour of the plug 120 around the tail 128 has substantially the same shape as the inner surface of the second tubular section 24*b* of the tubular pin 20. The outer contour of plug 120 thus has generally circular edges 126 which merge with concave radius edges or surfaces 124*a* and 124*b* which form the contour of the integral tail 128. Plug 120 is formed by bending the integral tail 128 upwardly and forming the wider section of the blank 136*b* around the integral plug 120. A metal to metal seal is thus formed by crimping a stamped and formed cylindrical pin around the generally circular plug 120. The width of the tab portion of the integral tail 128 is less than the inner diameter of the inner surface 22 of the tubular pin 20 in the second wider tubular section 24*b*. The blank is formed completely around the plug 120 including those portions of the integral tail 128 bent upwardly from the flat surface of the blank. However as shown in FIG. 13B, the diameter of the circular portion of the integral tail 128 is greater than the diameter of the inner surface 22 of the tubular pin 20 in the second wider tubular section 24*b*. To fully close the tubular section 24*b* around the circular portion of the integral tail 128 a radially constricting or crimping force must be applied to completely form the tubular section 24*b*. When the tubular section 24*b* is fully formed, as shown in FIG. 13C, a metal to metal sealed joint completely around the integral tail 128.

Figures 9, 10, 11, 12:
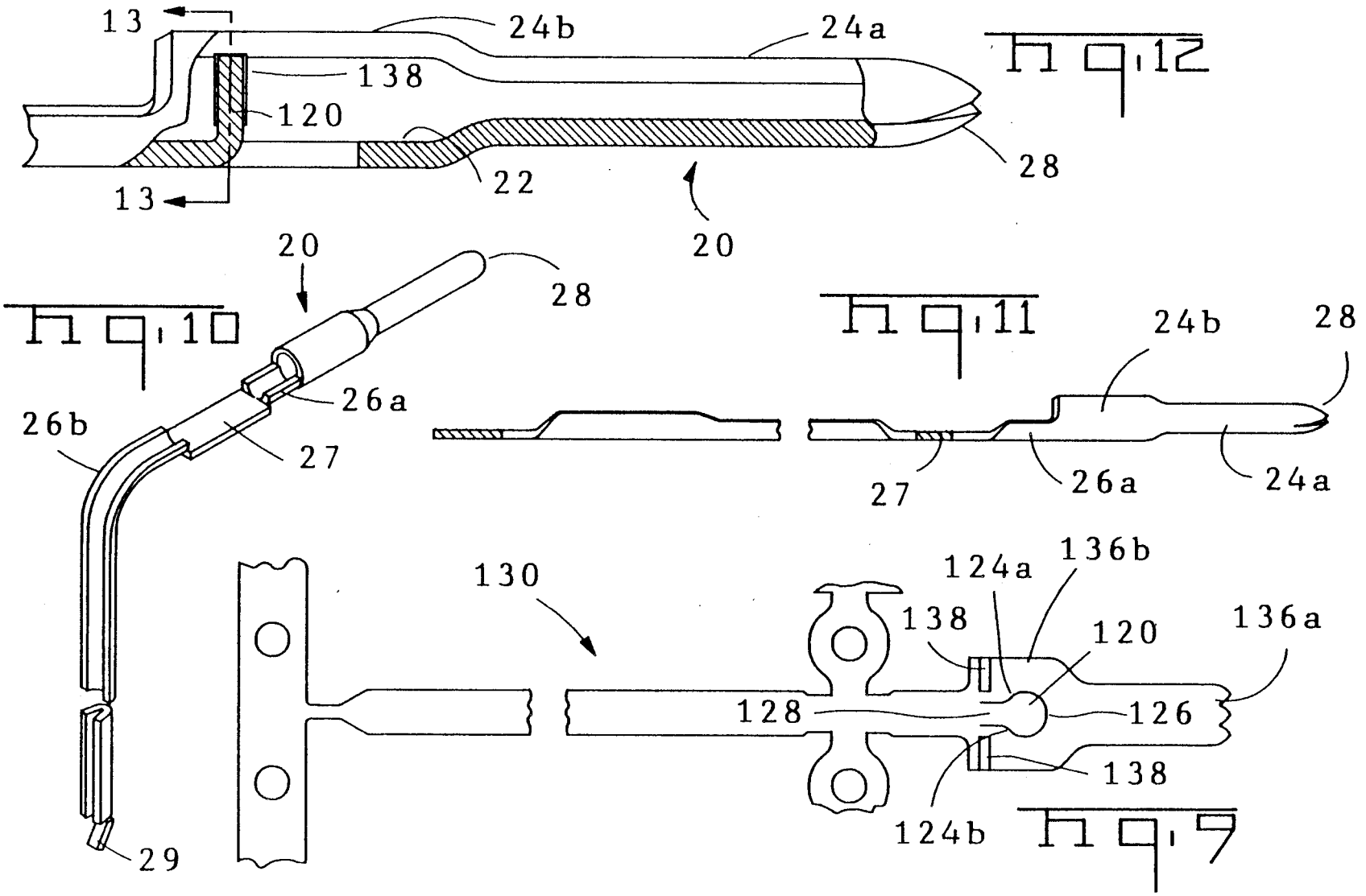
FIG. 9 shows a blank of the pin used in the pin header.
FIG. 10 is a perspective view of the fully stamped and formed pin.
FIG. 11 is a intermediate view of the stamped and formed pin prior to the time that the rear portion of the stamped and formed pin is bent in a right angle.
FIG. 12 is a view partially in section showing the manner in which the stamped and formed pin is plugged to seal a leak path through the interior of the stamped and formed pin.

In the preferred embodiment of this invention depressions 138 are formed on each side of the flat section 136*b*. These depressions 138 have a width substantially equal to the thickness of the blank and the edges of plug 120 are received within these depressions when the flat section 136*b* is formed around the plug to form the wider tubular section 24*b*. The manner in which this flat blank is formed around the integral plug 120 to form a seal for the leak path otherwise existing through the interior of the stamped and formed pin is best shown in FIG. 12, FIG. 13 and FIG. 13A.

Pins 20 are contained within a three row pin header 8 comprising a header housing 140 as best shown in FIGS. 1 and 5. The cylindrical or tubular portions of pins 20 extend into a header housing cavity 142 located on the front of a header bulkhead mounting section 144. A plurality of pin support platforms 146*a*, 146*b* and 146*c* extend from the rear of the header bulkhead section 144 in three rows. An angled bend is formed in channel section 26*b* of pins 20 and this right angle bend is located adjacent the rear edge of the pins 20 at the edges of platforms 146*a*, 146*b* and 146*c*. The plurality of pin stabilizing ribs 148 extend from the lower portion of the central header bulkhead 144 and have pin stabilizing ribs 148*a* and 148*b* located on opposed surfaces of pin stabilizing ribs 148. The channel shaped section on the rear of pins 20 fit within these pin stabilizing rib shoulders 148*a* and 148*b* to precisely position the pins for insertion into holes in a printed circuit board on which the header 8 is mounted. A plurality of keying ribs 150 are located on the inner surface of an outer header shroud 156 which forms the inner housing cavity 142 in which the receptacle connector 6 is inserted. These keying ribs 150 correspond to the profile of the support platforms 74 located on the secondary lock 60. When secondary lock 60 is properly positioned in the second position on the receptacle insulative housing 30, the receptacle connector 6 can be inserted into cavity 142 with platforms 74 being received between keying ribs 150. It should be noted that by properly positioning keying ribs 150 and by properly dimensioning the platform 74, the same basic connector can be used in a keyed configuration. Note that it would be possible to provide breakaway keying ribs 150 and breakaway platform sections 74 so that the same connectors could be easily keyed to prevent mating by improperly keyed connectors. The pin header housing 140 can be secured to a printed circuit board by the use of appropriate hold down members 154 of conventional construction. The receptacle connector 6 is secured to the header 8 by the connector latch 92 which engages latch shoulders 158 located on the exterior of the inner shroud 156 adjacent the mating face of the pin header 8.

The components comprising the receptacle connector 6 can be assembled in a shipped configuration prior to insertion of wires 4 terminated to receptacle terminal 10. The secondary lock 60 can be secured to the mating face of the insulative housing 30 in the first position by the two position retainer means. Latch finger 85A would be in engagement with the internal shoulders 84 and would be positioned between the internal shoulder 84 and the external shoulder 88 in this first position. Interfacial seal 100 would be positioned in surrounding relationship to the sidewalls 40 and the endwalls 38 of the connector prior to assembly of the secondary lock 60 to the mating face of the insulative housing 30. Note that the platforms 74 located on the exterior of the sidewalls 40 will serve to retain the interfacial seal 100 on the exterior of the housing 30. Seal 110 can be inserted within housing shroud 42 and the cap 90 can be secured to the housing shroud. In the event that it is desirable to program the cap 92 by removing selected projections 94, the seal 110 and the cap 90 can be assembled to the insulative housing 30 at the time wires are inserted into the connector. After the selected projection has been removed, and other projections remain, cap 90 can be assembled to the connector with the projections 94 closing off any unused holes 114 in the manner shown in FIG. 6. Terminated wires can then be inserted through open holes 114. Latches 50 will be deflected outwardly during insertion of the terminals 10 in the manner shown in FIG. 6. Note that since the latches 50 have not yet entered pocket 62, these latches are free to expand outwardly when the secondary lock is in the first position. After the terminals have been positioned in the connector, the engaging surfaces 58 on latches 50 are received within the waist section 16 in engagement with the barrel shoulder 15. In this configuration the terminals cannot be withdrawn from housing 30. With the latches 50 properly positioned as shown in FIG. 7, the secondary lock 60 is then free to move from the first position shown in FIG. 7 to the second position shown in FIG. 8. In FIG. 8 the latches 50 are received within the pocket 62 and latches 50 are not free to expand. Note that if any terminal is not fully inserted, thus allowing engaging surfaces 58 to move into the smaller diameter waist section 16 of the terminals 10, the secondary lock cannot be moved to the second position shown in FIG. 8.

I claim:

1. A pin for use as an electrical terminal, the pin being stamped and formed from a metal blank into a tubular shape said blank being provided with a depression on an interior surface of a predetermined width; a plug being partially sheared from and remaining joined to the blank by an integral tail, the contour of the plug having substantially the same shape as the inner surface of the tubular pin, the tail being bent with the plug being formed up so that the blank is formed and crimped around the plug with an edge thereof being received in said depression and with the interior of the pin being closed off by the plug.

2. The pin of claim 1 wherein the pin has a tapered nose.

3. The pin of claim 1 wherein the outer contour of the plug comprises a circular portion joined to the integral tail, the circumference of the circular portion being initially greater than the width of the inner surface of the blank on opposite sides of the plug, the blank being crimped around the plug into a closed tubular shape deforming the plug so that a metal to metal seal is formed between the plug and the tubular pin on the inner surface thereof.

4. The pin of claim 1 wherein the width of the tail is less than the inner dimension of the inner surface of the tubular pin.

5. The pin of claim 4 wherein edges of the tail are joined to the outer contour of the plug by concave radiused surfaces.

6. The pin of claim 1 wherein the metal blank has a first section and a wider second section, first and and second tubular sections being formed when the blank is formed into a tubular shape, the outer diameter of the second tubular section being larger than the outer diameter of the first tubular section.

7. The pin of claim 6 wherein the plug is located in the second tubular section.

8. The pin of claim 7 wherein the pin includes a third section, the third section comprising a channel, open on one side, extending between the second section and an end of the pin.

9. A sealed electrical connector assembly comprising:

two electrical connectors;

electrical conductors in each connector, the electrical conductors in one of the connectors comprising first members, said members being stamped and cylindrically formed from a blank and having a depression on an interior surface;

interfacial sealing means at the mating interface between the two connectors; and individual conductor sealing means in each connector, the individual conductor sealing means for the first members comprising a plug stamped from said blank and crimped within each first member and with an edge of said plug being received in said depression.

10. The sealed electrical connector assembly of claim 9 wherein the first stamped and cylindrically formed members comprise cylindrical pins.

11. The sealed electrical connector assembly of claim 10 wherein an interference fit is formed between the cylindrical pins and the insulative housing of one of the connectors to form a seal around the exterior of the pins.

12. The sealed electrical connector assembly of claim 10 wherein the electrical connector containing the pins comprises a pin header.

13. The sealed electrical connector assembly of claim 12 wherein the other electrical connector comprises a receptacle connector and the conductors therein comprise terminals attached to wires.

14. The sealed electrical connector assembly of claim 13 wherein the conductor sealing means in the other connector comprises an elastomeric seal surrounding the wires.

15. The sealed electrical connector assembly of claim 14 wherein the elastomeric seal is secured in the other connector by a cap.

16. The sealed electrical connector assembly of claim 15 wherein the elastomeric seal comprises a single member having a plurality of holes, each hole receiving one wire, the cap having projections received within any hole in the elastomeric seal through which a wire is omitted.

* * * * *